United States Patent [19]

Haftmann et al.

[11] Patent Number: 4,990,006

[45] Date of Patent: Feb. 5, 1991

[54] HOLDER OF A RIBBON FOR TYPEWRITERS OR SIMILAR MACHINES

[75] Inventors: Johannes Haftmann, Schwabach; Werner Haczek, Furth, both of Fed. Rep. of Germany

[73] Assignee: Ta Triumph Adler Aktiengesells, Nuremberg, Fed. Rep. of Germany

[21] Appl. No.: 278,820

[22] Filed: Dec. 2, 1988

[30] Foreign Application Priority Data

Dec. 7, 1987 [DE] Fed. Rep. of Germany ..... 3741361

[51] Int. Cl.[5] ..... B41J 35/28

[52] U.S. Cl. ..... 400/208; 242/198

[58] Field of Search ..... 400/208, 208.1, 235.1, 400/207; 242/198

[56] References Cited

U.S. PATENT DOCUMENTS

| | | | |
|---|---|---|---|
| 3,094,204 | 6/1963 | Landgraf | 400/208.1 |
| 3,151,724 | 10/1964 | Ross et al. | 400/208.1 |
| 3,272,304 | 9/1966 | Morelli | 400/208.1 |
| 3,396,828 | 8/1968 | Moshier et al. | 400/208.1 |
| 4,329,073 | 5/1982 | Craft | 400/208 |
| 4,655,623 | 4/1987 | Gasser | 400/228 |

FOREIGN PATENT DOCUMENTS

| | | | |
|---|---|---|---|
| 2930115 | 2/1981 | Fed. Rep. of Germany | 400/208 |
| 0090164 | 10/1983 | Fed. Rep. of Germany | 400/208 |
| 8310441 | 7/1984 | Fed. Rep. of Germany | 400/208 |
| 0122755 | 10/1984 | United Kingdom | 400/208 |

*Primary Examiner*—Eugene H. Eickholt

*Attorney, Agent, or Firm*—Browdy and Neimark

[57] ABSTRACT

A holder of a ribbon for typewriters or similar machines in which the ribbon can be transferred from a supply spool to a take-up spool and where the two spools are disposed on a slider. By means of the invention it is intended to manufacture the slider for the two spools in as simple a manner as possible and without further assembly steps. This is made possible when the holder, together with the slider for the ribbon spools, is initially made as a one-piece plastic part. It may also have a pivotable cover so that a cassette is formed after insertion of the spools and closing of the cover. The one-piece construction of the holder with the slider also makes securing for transport unnecessary. When the holder is inserted into a correspondingly designed receptacle, the slider is separated from the holder by breaking off from thin connecting points at so-called predetermined breaking points and it is positioned a little higher than the holder on the respective guide bars of the receptacle. After laterally pivotable side elements of the receptacle have been moved in, the ribbon is in a functionally correct position in the typewriter or the printer. Because of this design of the holder in connection with the receptacle, simple manipulation in the course of the insertion of a new ribbon is achieved.

9 Claims, 2 Drawing Sheets

HOLDER OF A RIBBON FOR TYPEWRITERS OR SIMILAR MACHINES

FIELD OF THE INVENTION

The invention relates to a holder of a ribbon for typewriters or similar machines in which the ribbon can be transferred from a supply spool to a take-up spool and where both spools are disposed on a slider.

BACKGROUND OF THE INVENTION

Such ribbon cassettes are known from, e.g. German Utility Model GE-GM 83 10 441. These ribbon cassettes are made of several parts and are assembled. This requires, on the one hand, considerable expense for the several tools. Furthermore, drive, braking and tensioning elements must be provided in the ribbon cassette which are discarded when the ribbon is used up. As a whole, such ribbon cassettes for typewriters and printers are usually offered at a relatively high cost.

SUMMARY OF THE INVENTION

It is an object of the invention to design the holder of a ribbon which can be transferred from a supply spool to a take-up spool in such a way that it can be manufactured as a one-piece plastic element. Furthermore, handling in connection with a receptacle is to be made as simple as possible for an operator. In accordance with the present invention, this is achieved by providing a holder and a slider, or sliding element in the form of one-piece plastic parts. The slider can be broken off the holder at thin bars, which are in the form of predetermined breaking points, when the holder is placed on a receptacle. In this way the holder can be manufactured as a one-piece plastic molded part. No assembly operations beyond the insertion of the ribbon spools are required. If the holder is provided with a cover in the manner of a ribbon cassette, it can be connected with the base element pivotable around hinges in such a way that after pivoting, guide pins enter corresponding recesses of the base element. Simultaneously there is the advantage that the slider on which the two spools are seated does not require securing against sliding out laterally. After insertion of the holder into a receptacle provided for this purpose, however, the slider breaks off the base element and automatically attains its functionally correct position. The drive, braking and tensioning elements are provided in the receptacle and cooperate in a functionally correct manner with the ribbon or the supply and take-up spools. Functioning of the holder of the ribbon can be in the manner of a cassette as shown and described, for example, in German Utility Model DE-GM 83 10 441.

An embodiment in which the thin bars are disposed at V-shaped depressions between the holder and the slider assures in a simple manner that burrs possibly present after the break-out of the slider will not hinder its lateral movement.

A further preferred embodiment of the holder is that the slider slidingly rests in its operational position on guide bars of the receptacle such that the slider is positioned a little above the base plate of the holder. Furthermore, it is advantageous if the holder is embodied in the shape of a ribbon cassette. But this type of ribbon cassette as a holder of the ribbon no longer requires drive, braking and tensioning elements.

Still other objects, features and attendant advantages of the present invention will become apparent to those skilled in the art from a reading of the following detailed description of the embodiments constructed in accordance therewith, taken in conjunction with the accompanying drawings.

BRIEF DESCRIPTION OF THE DRAWINGS

The drawings show an exemplary embodiment of the invention in a schematic view.

DETAILED DESCRIPTION OF A PREFERRED EMBODIMENT

Figure 1:
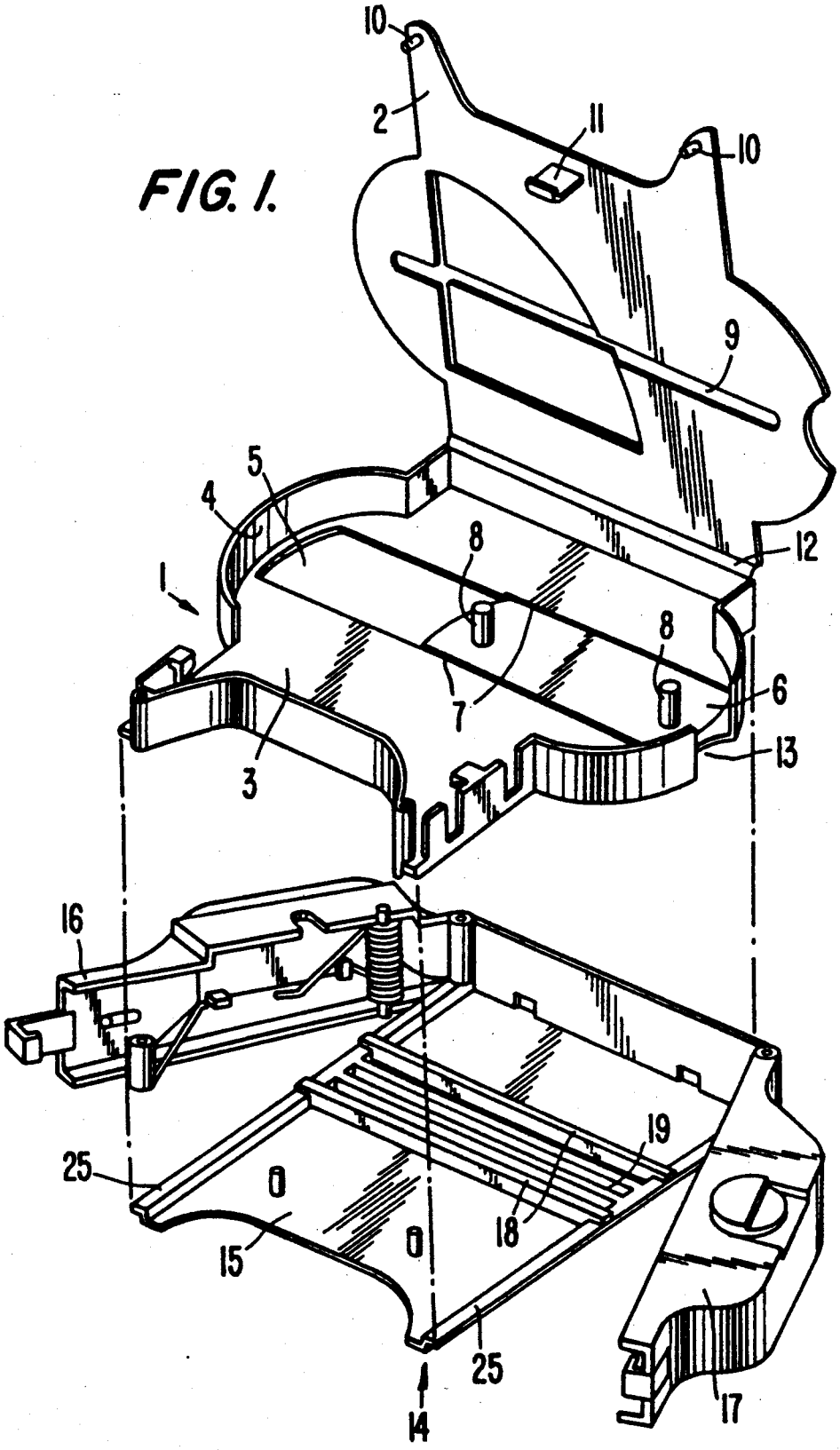
FIG. 1 is a schematic view of the holder above its receptacle and without inserted spools.

The holder 1 as shown in FIG. 1 is in the form of a ribbon cassette with an upwardly pivotable lid 2. A broad slot in which the slider or sliding element 5, 6 is fixed, is formed in the base element 3, which is surrounded by a wall 4 extending on all sides. The connection between the base plate 3 and the slider 6 consists of very thin bars 7, or predetermined breaking points provided as predetermined breaking points. Four such bars 7 can be seen in the drawings. Furthermore, receiving shafts 8 are formed on the slider 6 on which can be placed the supply and take-up spools not shown in FIG. 1. A small slit 9 is formed in the lid 2 parallel to and above the slot 5 into which the receiving shafts 8 of the slider 6 can enter when the latter moves to the left in the drawing as the diameter of the take-up spool increases. Pin-like, 10, or hooklike, 11, locking elements may be provided on the lid 2. The lid 2 is connected at 12 with the base element 3 by means of a definite thinned portion or strip of the material. This hinge is only of importance as far as it has to withstand the pivot movement when the lid is closed.

At 13 there is a recess in the base element 3, through which the drive for the ribbon can enter. This, for example, is a sprocket wheel which is drivable by the machine and against which the take-up spool presses in a known manner. With the increase caused by the used ribbon in the diameter of the take-up spool, the slider 6 with the two spools is moved in the slot 5 against the action of a spring to the left in the drawing.

The receptacle for the holder 1 has been designated with 14. It consists of a base plate 15 on which are provided pivotable lateral elements 16 and 17. These lateral elements surround the holder 1, once it has been inserted in a functionally correct manner, on all sides in the form of a shell after the pivotable elements have been pivoted back in towards the base plate 15. Raised guide bars 18 and a slit 19 between them are disposed on the base element 15 of the receptacle 14. The guide bars 18 and the slit 19 are particularly clearly shown in the sectional view in FIG. 2. A slide guide 20 for the slider 6 extends into the slit 19 when the holder 1 is placed on the receptacle 14. These slide guides 20, together with the receiving shafts 8 for the supply spool 21 and the take-up spool 22, form the guide for the slider 6 during its movement.

Figure 2:
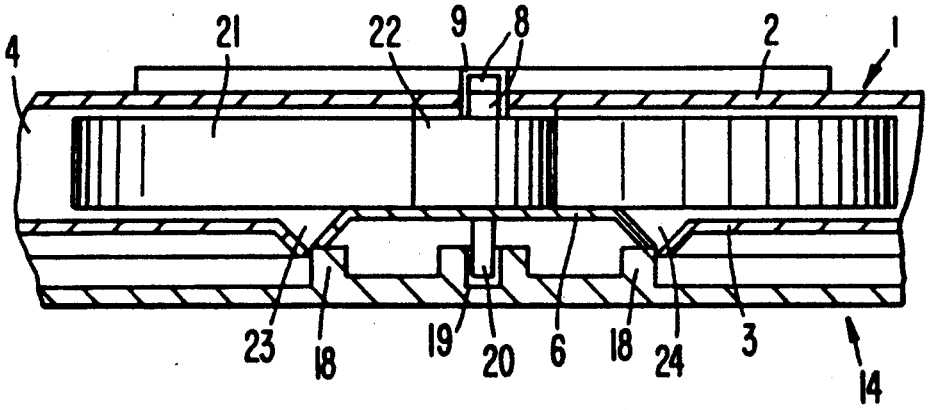
FIG. 2 is a greatly enlarged sectional view of the holder with the holder placed on a receptacle.

Differing from the exemplary embodiment according to FIG. 1, FIG. 2 shows that the parallel lateral edges of the slider 6 and of the base element 3 of the holder 1, seen as a whole, form V-shaped depressions 23 and 24 in the area of the slot 5. The above mentioned thin bars 7 or predetermined breaking points are disposed at the lower edge of these V-shaped depressions. In the form in which the holder 1 leaves the mold, the base plates 3 and the slider 6 are located on a common plane. If the holder 1 is placed functionally correctly with some pressure on the receptacle 14, the thin bars 7 are broken off by the raised guide bars 18, so that the holder 1 rests on the edges 25 of the receptacle 14, while the slider 6 comes to rest on the guide bars 18. As clearly shown in FIG. 2, the slider 6 is positioned somewhat higher than the base element 3 of the holder 1. In this way this design has two different functions. On the one hand, the breaking off of the thin bars makes it possible and on the other hand assures that possibly existing burrs in the area of the thin places 7 do not interfere with each other when the slider 6 slowly moves towards the left in the course of the operation of the ribbon cassette.

The other parts in the pivotable lateral parts 16 and 17 visible FIG. 1 are used as functional elements during the operation of the ribbon cassette, but have no direct relation to the present invention. It is therefore not necessary in the course of this description to address them further. It is quite obvious that the ribbon cassette manufactured as holder 1 can be manufactured as a very low-priced plastic molded part and that no further assembly steps are required beyond the insertion of the ribbon spools for the supply and take-up. It is further clear that after the ribbon has been used up, only the holder 1 with the ribbon needs to be discarded, while all other parts are reusable.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation.

What is claimed is:

1. A holder of a ribbon for typewriters or similar machines where the ribbon can be transferred from a supply spool to a take-up spool, comprising:

a slider on which both spools are disposed, the holder and the slider being in the form of one-piece plastic part; and bars connecting the slider and the holder in the form of predetermined breaking points, such that the slider can be broken off the holder when the holder is placed on a receptacle.

2. A holder in accordance with claim 1, wherein the bars are disposed at a V-shaped depression between the holder and the slider.

3. A holder in accordance with claim 1, wherein the slider slidingly rests in its operational position on guide bars of the receptacle such that the slider is positioned a above the base plate of the holder.

4. A holder in accordance with claim 1, wherein the holder is in the form of a ribbon cassette.

5. A holder in accordance with claim 2, wherein the slider slidingly rests in its operational position on guide bars of the receptacle such that the slider is positioned a above the base plate of the holder.

6. The holder housing of claim 1, characterized in that the thin bars (7) are disposed on a V-shaped depression (23, 24) between the holder housing (1) and slider (6).

7. The holder housing of claim 1, characterized in that the slider (6), in its working position, slidably rests on guide bars (18) of the receptacle (14), in such a manner that the slider (6) is located above the holder base (3) of the holder housing (1).

8. The holder housing of claim 1, characterized in that the holder housing (1) is integrally embodied with a hinged lid (2).

9. A holder housing of a ribbon for typewriters or similar machines, wherein the holder housing has at least one flat plate with side walls disposed on it and guides for the ribbon, wherein the ribbon can be wound from a supply spool onto a take-up spool, and wherein both spools are rotatably supported on a slide provided with suitable retaining devices, characterized in that;

the holder housing (1) and the slide (6) are embodied as a single plastic part, and the slider (6) can be broken away from the holder base (3) at bars (7) having predetermined breaking points, when the holder housing (1) is placed upon a receptacle (14) provided with raised guide bars (18, 19) acting upon the slider (6).

* * * * *